US012660899B2

(12) United States Patent
Chiang

(10) Patent No.: US 12,660,899 B2
(45) Date of Patent: Jun. 23, 2026

(54) SIDE-OPENING TYPE SUITCASE

(71) Applicant: LOJEL MANUFACTURING CO., LTD., Taichung City (TW)

(72) Inventor: Hsi-Wu Chiang, Taichung City (TW)

(73) Assignee: LOJEL MANUFACTURING CO., LTD, Taichung City (TW)

( * ) Notice: Subject to any disclaimer, the term of this patent is extended or adjusted under 35 U.S.C. 154(b) by 50 days.

(21) Appl. No.: 18/593,306

(22) Filed: Mar. 1, 2024

(65) Prior Publication Data

US 2025/0089866 A1 Mar. 20, 2025

(30) Foreign Application Priority Data

Sep. 15, 2023 (TW) ..... 112135287

(51) Int. Cl.

| | |
|---|---|
| ***A45C 5/03*** | (2006.01) |
| ***A45C 5/06*** | (2006.01) |
| ***A45C 5/14*** | (2006.01) |
| ***A45C 13/10*** | (2006.01) |

(52) U.S. Cl.

CPC ..... *A45C 5/03* (2013.01); *A45C 5/06* (2013.01); *A45C 5/14* (2013.01); *A45C 13/103* (2013.01); *A45C 2005/037* (2013.01)

(58) Field of Classification Search

None

See application file for complete search history.

(56) References Cited

U.S. PATENT DOCUMENTS

| | | | | |
|---|---|---|---|---|
| 7,837,032 | B2 * | 11/2010 | Smeltzer | A63B 55/00 190/902 |
| 8,453,813 | B2 * | 6/2013 | Lai | A45C 5/14 190/110 |
| 9,894,970 | B2 * | 2/2018 | Sheikh | A45C 13/00 |
| 11,510,467 | B2 * | 11/2022 | Chiang | A45C 13/02 |
| 2006/0112523 | A1 * | 6/2006 | Deto | A41F 1/002 24/303 |
| 2014/0027224 | A1 * | 1/2014 | Lai | A45C 5/14 190/111 |

* cited by examiner

*Primary Examiner* — Tri M Mai

(74) *Attorney, Agent, or Firm* — MUNCY, GEISSLER, OLDS & LOWE, P.C.

(57) ABSTRACT

A side-opening type suitcase includes a shell having a side opening and an accommodation space, a lid disposed to the side opening, an outer zipper provided between the side opening of the shell and the lid, a partition having a fixing portion and a bending portion connected with the fixing portion and configured to be bent relative to the fixing portion, and an inner zipper provided between an outer edge of the fixing portion and the side opening of the shell. The bending portion is provided with a first connecting member and the side opening of the shell is provide with a second connecting member detachably connected with the first connecting member. As such, the suitcase of the present invention allows users to reach into the accommodation space to take out luggage while unzipping the outer zipper and bending the bending portion of the partition.

7 Claims, 5 Drawing Sheets

SIDE-OPENING TYPE SUITCASE

BACKGROUND OF THE INVENTION

1. Field of the Invention

The present invention relates to suitcases and more particularly, to a side-opening type suitcase that when it is opened, the luggage inside will not be entirely exposed.

2. Description of the Related Art

A conventional suitcase typically has a clamshell design, where both sides open up. This design results in a mix of user's work-related items (such as a laptop) and personal belongings (such as clothing) being stored together. In addition to causing inconvenience when picking up items, the conventional design may lead to awkward situations where personal belongings are exposed if a user urgently needs to search for a specific item and opens the entire suitcase. It can be seen that the structural design of the conventional suitcase is not perfect and there is still room for improvement.

SUMMARY OF THE INVENTION

It is one objective of the present invention to provide a side-opening type suitcase, which when the side-opening type suitcase is opened, the inside luggage will not be completely exposed.

To attain the above objective, the side-opening type suitcase of the present invention comprises a shell, a lid, an outer zipper, a partition, and an inner zipper. The shell has a side plate and a frame member surrounding and connected to a periphery of the side plate to define an accommodation space with the side plate. The frame member has a side opening communicating with the accommodation space. The lid is disposed to the side opening and has a first outer edge. The outer zipper has a first outer zipper unit provided at the side opening of the shell, and a second outer zipper unit provided at the first outer edge of the lid and engaged with the first outer zipper unit. The partition is disposed between the shell and the lid, including a fixing portion provided with a second outer edge and a bending portion connected with the fixing portion and configured to be bent relative to the fixing portion. The inner zipper has a first inner zipper unit provided at the side opening of the shell, and a second inner zipper unit provided at the second outer edge of the partition and engaged with the first inner zipper unit. The bending portion is provided with a first connecting member, and the side opening of the shell is provided with a second connecting member detachably connected with the first connecting member.

It can be seen from the above that when the user needs to take out the luggage inside the suitcase, the user pulls the bending portion of the partition to bend the bending portion towards the fixing portion after unzipping the outer zipper, thereby exposing a small part of the accommodation space. In this way, the user can reach in and take out the luggage through a small opening formed by the bending portion. During the entire process of taking out the luggage, only a small part of the accommodation space will be exposed, so that the luggage inside the suitcase will not be entirely visible externally. Therefore, the structural design of the suitcase of the present invention has better privacy and avoids the embarrassing situation of personal belongings being exposed.

In one aspect, although the suitcase of the present invention is designed with a side-opening structure, it is not excluded that the shell can also be provided with a zipper, so that the entire suitcase can also be a clamshell-type structure.

In another aspect, the suitcase may also include at least one connecting strip, and the number of the connecting strip may be increased or decreased depending on the actual situation. The second connecting member is mounted to the connecting strip and provided at the side opening of the shell through the connecting strip.

In another aspect, the first and second connecting members may be, for example, a set of magnetic members, a set of hook and loop tapes, or other objects with connecting effects. When the first connecting member and the second connecting member are both magnetic members, the first connecting member is detachably magnetically attracted to the second connecting member.

In another aspect, the frame member may include a first frame and second frame. The first frame is disposed between the side plate and the second frame and directly connected with the side plate. The shell further includes an expansion component that have an expansion cloth connected between the first frame and the second frame, and a connecting zipper connected between the first frame and the second frame and located outside the expansion cloth for releasing the expansion cloth to expand the second frame from a contracted position to an expanded position. Finally, the capacity of the accommodation space of the suitcase is increased.

In another aspect, the accommodation space is defined between the side plate, the frame member, and the partition.

In another aspect, when the first connecting member is connected with the second connecting member, the partition covers the entire accommodation space.

In another aspect, the bending portion of the partition is provided with a pull member to facilitate the user to pull the bending portion.

In another aspect, when the bending portion is pulled to bend towards the fixing portion, the partition partially covers the accommodation space.

Other advantages and features of the present invention will be fully understood by reference to the following specification in conjunction with the accompanying drawings, in which like reference signs denote like components of structure.

DETAILED DESCRIPTION OF THE INVENTION

Figure 1:
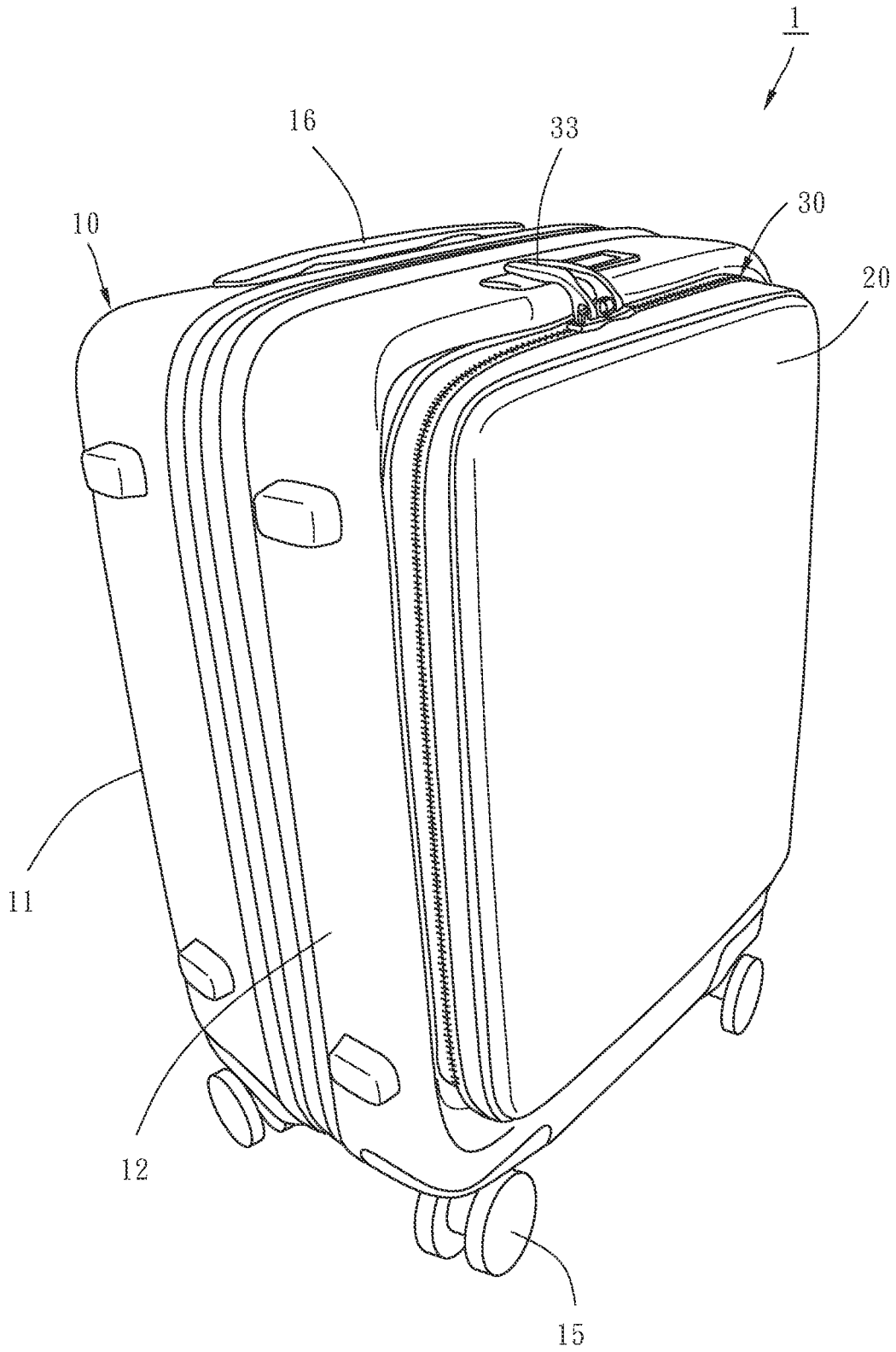
FIG. 1 is a perspective view of a suitcase of the present invention.
Figure 2:
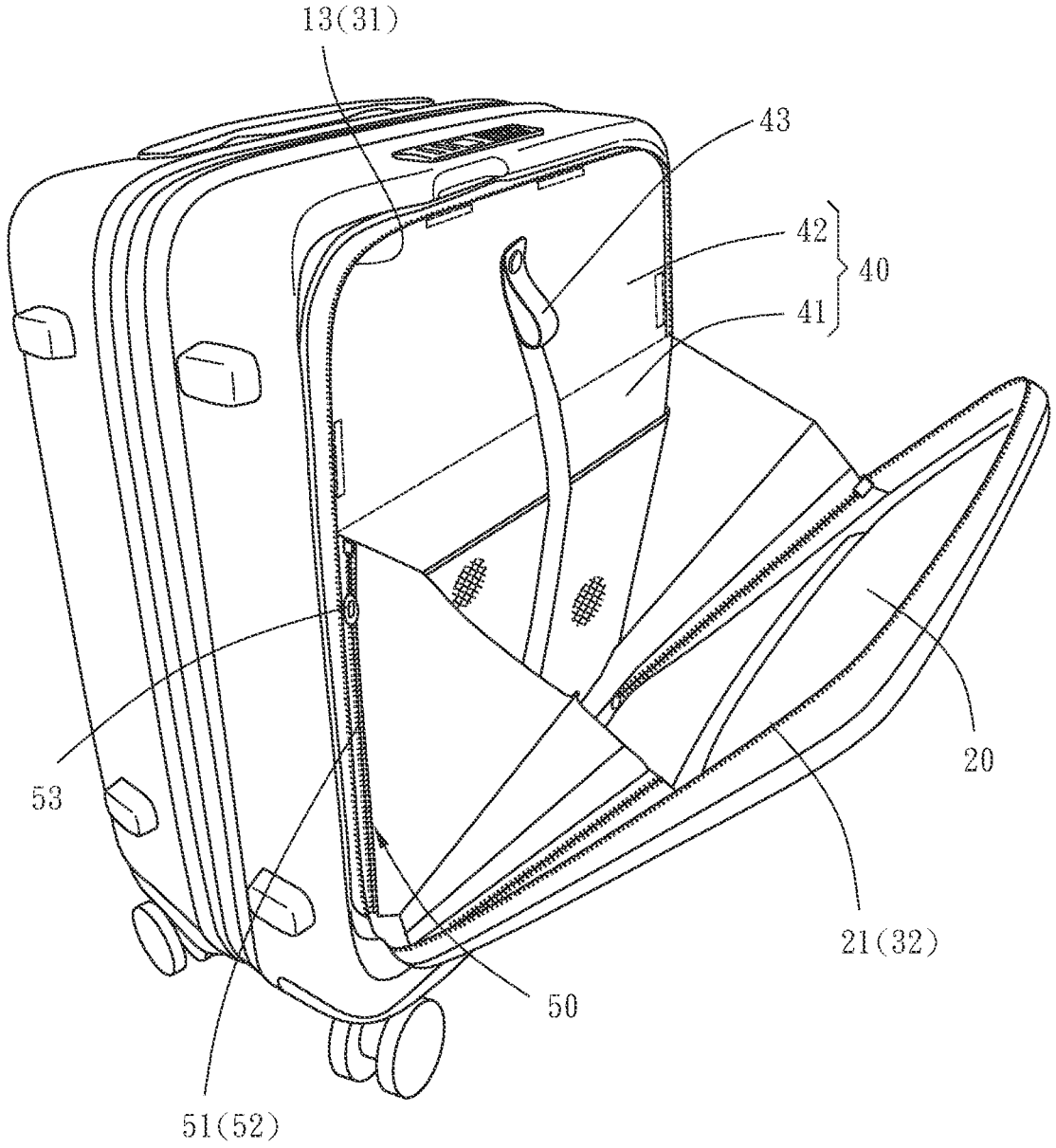
FIG. 2 is another perspective view of the suitcase of the present invention, showing that the lid is pulled out.
Figure 3:
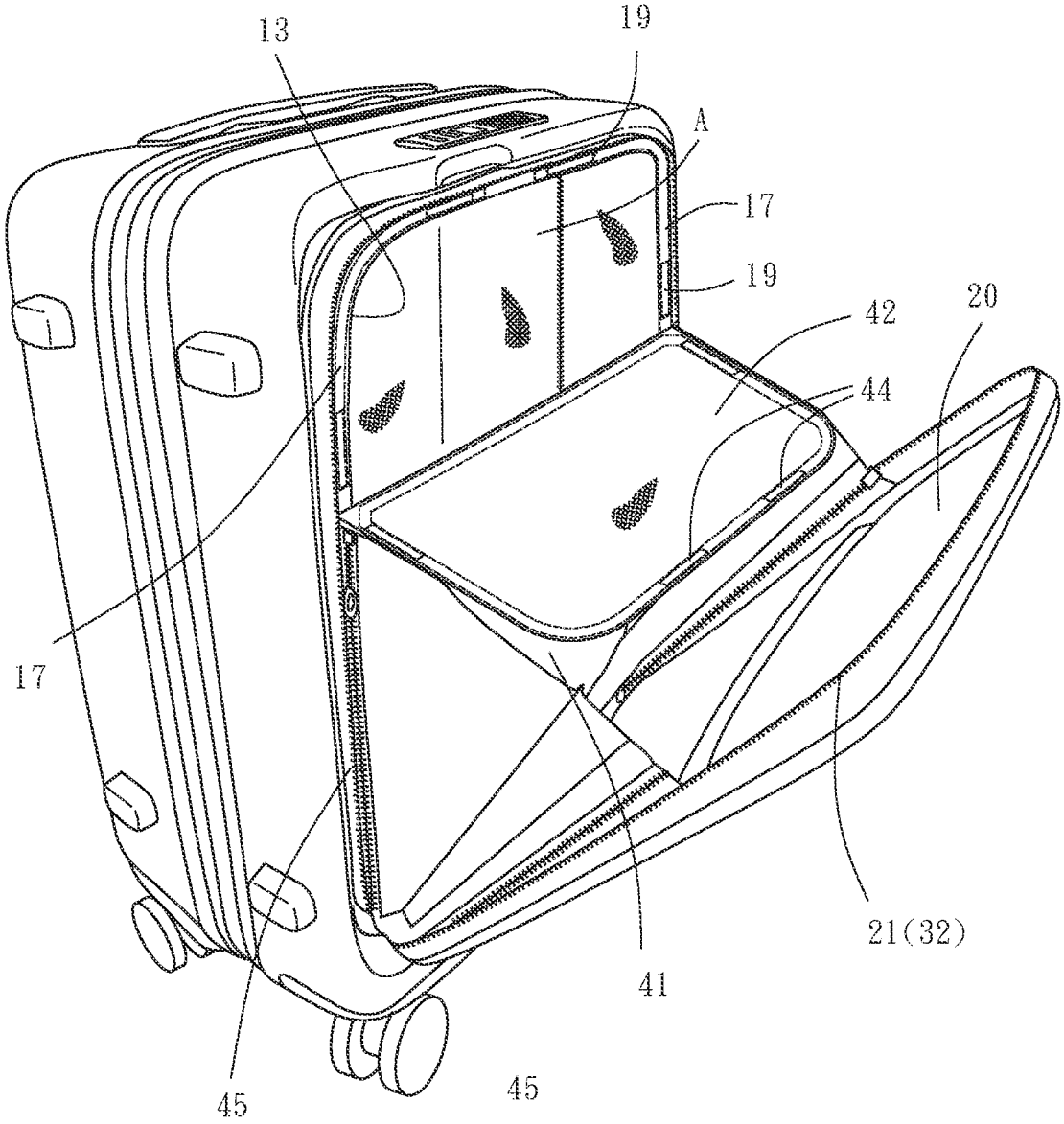
FIG. 3 is similar to FIG. 2, showing that the bending portion of the partition is pulled out.

As shown in FIGS. 1-3, a side-opening suitcase 1 of the present invention comprises a shell 10, a lid 20, an outer zipper 30, a partition 40, and an inner zipper 50.

Figure 6:
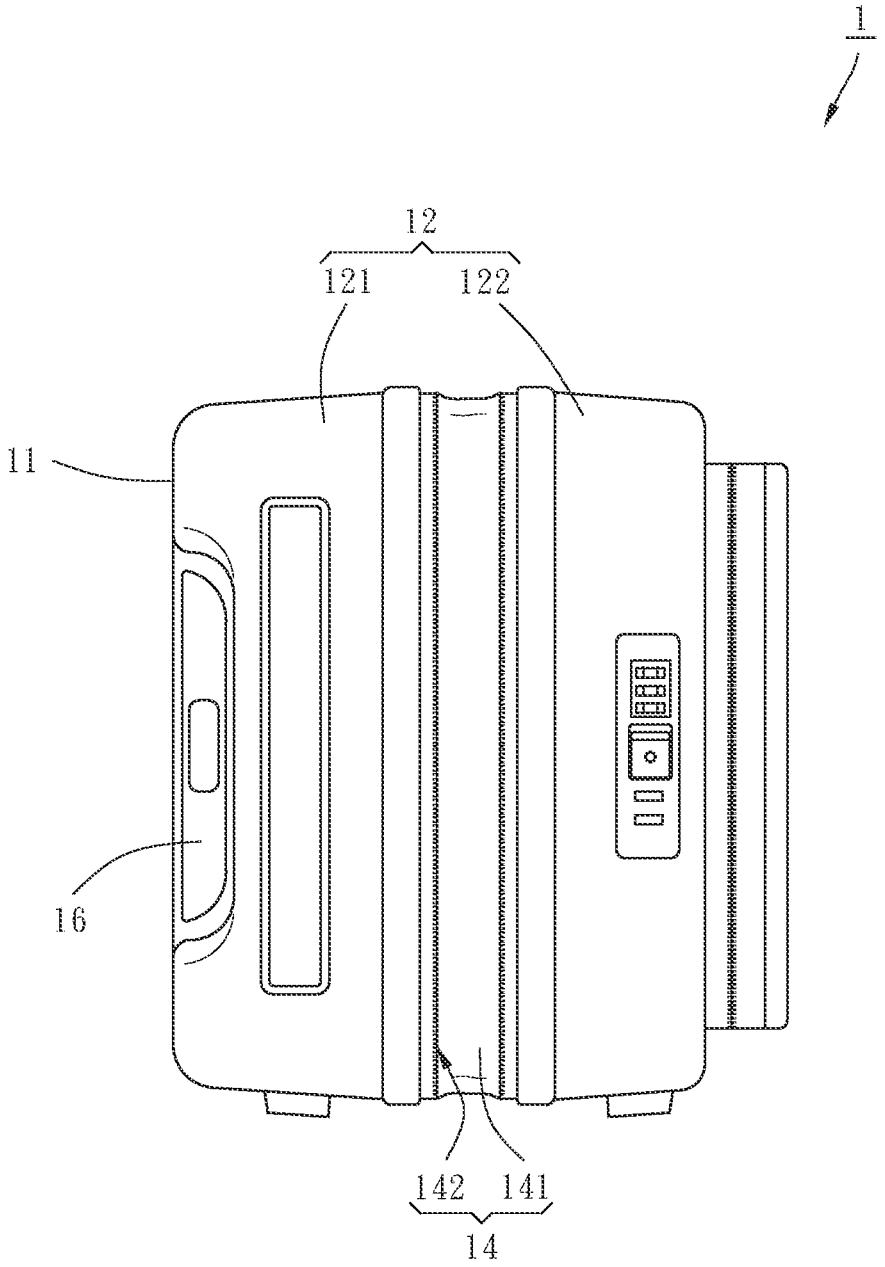
FIG. 6 is a top view of the suitcase of the present invention, showing that the connecting zipper is unzipped.

The shell 10 includes a side plate 11 and a frame member 12 surrounding and connected with the periphery of the side plate 11 to define an accommodation space A with the side plate 11 for accommodation of luggage. The frame member 12 has a side opening 13 (see FIG. 3) communicating with the accommodation space A. Normally, the bottom side of the frame member 12 is also provided with a wheel set 15, and the shell 10 is also provided with a pull rod 16 for the user to pull the suitcase 1. On the other side, as shown in FIG. 6, in this embodiment, the frame member 12 includes a first frame 121 and a second frame 122. The first frame 121 is disposed between the side plate 11 and the second frame 122 and directly connected with the side plate 11. The shell 10 further includes an expansion component 14 that has an expansion cloth 141 connected between the first frame 121 and the second frame 122, and a connecting zipper 142 connected between the first frame 121 and the second frame 122 and located outside the expansion cloth 141 for releasing the expansion cloth 141 to expand the second frame 122 from a contracted position to an expanded position, or contract the expansion cloth 141 to move the second frame 122 from the expanded position to the contracted position, thereby changing the capacity of the accommodation space A. Certainly, in some cases, the expansion cloth 141 may be omitted, allowing the shell 10 to form a clamshell-type structure by the connecting zipper 142. This enables the user to unzip the connection zipper 142 and reach into the accommodation space A to take out the luggage.

As shown in FIG. 2, the lid 20 is disposed to the side opening 13 of the shell 10 and has a first outer edge 21.

The outer zipper 30 includes a first outer zipper unit 31 provided at the side opening 13 of the shell 10, a second outer zipper unit 32 provided at the first outer edge 21 of the lid 20, and a first zipper tab 33 (see FIG. 1) used to link the first outer zipper unit 31 with the second outer zipper unit 32, so that the lid 20 can be detachably connected to the side opening 13 of the shell 10.

Figure 4:
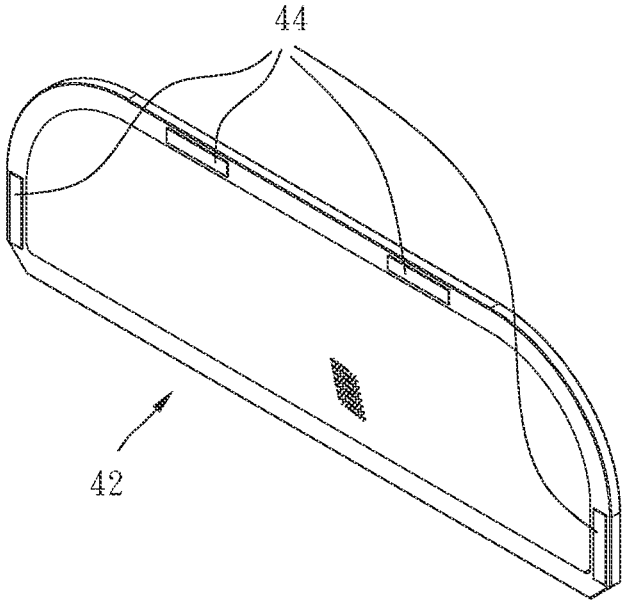
FIG. 4 is an enlarged view of a partition provided by the bending portion of the partition.
Figure 5:
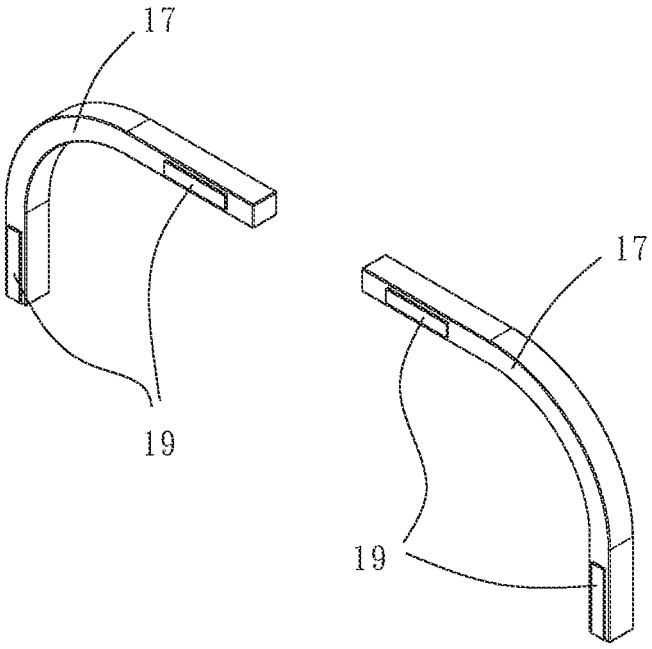
FIG. 5 is a perspective view of a connecting strip provided by the suitcase of the present invention, showing the arrangement of the second connecting member.

As shown in FIGS. 2 and 3, the partition 40 is disposed between the shell 10 and the lid 20 and includes a fixing portion 41 and a bending portion 42. Based on the direction of FIG. 2, the bending portion 42 is connected to the upper side of the fixing portion 41 through sewing cloth, so that the bending portion 42 can be pulled and bent relative to the fixing portion 41. The fixing portion 41 has a second outer edge 45 extending from the front side of the fixing portion 41 to the bottom side of the fixing portion 41 and the rear side of the fixing portion 41. The bending portion 42 is provided with a pull member 43 to facilitate the user to bend the bending portion 42 relative to the fixing portion 41. The outer edge of the bending portion 42 is also provided with four first connecting members 44 arranged in a spaced manner (as shown in FIG. 4). The first connecting member 44 is a magnetic member (such as a magnet). On the other side, the side opening 13 of the shell 10 is also provided with two connecting strips 17. Each connecting strip 17 is provided with two second connecting members 19 (the second connecting members 19 are four in total number). The second connecting member 19 is also a magnetic member in this embodiment. The positions of the second connecting members 19 correspond to the positions of the first connecting members 44, and the second connecting members 19 are detachably magnetically attracted to the first connecting members 44. When the first connecting members 44 are magnetically attracted by the second connecting members 19, the bending portion 42 is in an unbent state and located on the same plane as the fixing portion 41. As such, the partition 40 covers the entire accommodation space A that is defined between the side plate 11, the frame member 12, and the partition 40. When the bending portion 42 is pulled by the pull member 43 to bend towards the fixing portion 41, the partition 40 only partially covers the accommodation space A, allowing the user to reach into the accommodation space A and take out the luggage.

The inner zipper 50 includes a first inner zipper unit 51 provided at the side opening 13 of the shell 10, a second inner zipper unit 52 provided at the second outer edge 45 of the fixing portion 41 of the partition 40, and a second zipper tab 53 used to link the first inner zipper unit 51 with the second inner zipper unit 52.

Through the structural design of the suitcase 1 of the present invention, when the user needs to take out the luggage inside the suitcase 1, after unzipping the outer zipper 30, the user pulls the pull member 43 to bend the bending portion 42 towards the fixed portion 41. Thereafter, a small part of the accommodation space A is exposed, so that the user can take out the luggage through a small opening formed by the bending portion 42 after bending. During the entire process of taking out the luggage, only a small part of the accommodation space A of the suitcase 1 will be exposed, so that the luggage inside the suitcase 1 will not be exposed entirely. Therefore, the structural design of the suitcase of the present invention has better privacy and avoids the embarrassing situation of personal belongings being exposed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A side-opening type suitcase comprising:

a shell having a side plate and a frame member surrounding and connected to a periphery of the side plate to define an accommodation space with the side plate, the frame member having a side opening communicating with the accommodation space;

a lid disposed to the side opening and having a first outer edge;

an outer zipper having a first outer zipper unit provided at the side opening of the shell, and a second outer zipper unit provided at the first outer edge of the lid and engaged with the first outer zipper unit;

a partition disposed between the shell and the lid and having a fixing portion provided with a second outer edge and a bending portion connected with the fixing portion and configured to be bent relative to the fixing portion; and an inner zipper having a first inner zipper unit provided at the side opening of the shell, and a second inner zipper unit provided at the second outer edge of the fixing portion of the partition and engaged with the first inner zipper unit;

wherein the bending portion is provided with a first connecting member, and the side opening of the shell is provided with a second connecting member detachably connected with the first connecting member;

wherein the first connecting member and the second connecting member are both magnetic members, and the first connecting member is detachably magnetically attracted to the second connecting member.

2. The side-opening type suitcase as claimed in claim 1, wherein the second connecting member is mounted to at least one connecting strip and provided at the side opening of the shell through said at least one connecting strip.

3. The side-opening type suitcase as claimed in claim 1, wherein the frame member includes a first frame and a second frame; the first frame is disposed between the side plate and the second frame and directly connected with the side plate; the shell further includes an expansion component that has an expansion cloth connected between the first frame and the second frame, and a connecting zipper connected between the first frame and the second frame and located outside the expansion cloth for releasing the expansion cloth to expand the second frame from a contracted position to an expanded position.

4. The side-opening type suitcase as claimed in claim 1, wherein the accommodation space is defined between the side plate, the frame member, and the partition.

5. The side-opening type suitcase as claimed in claim 1, wherein when the first connecting member is connected with the second connecting member, the partition covers the entire accommodation space.

6. The side-opening type suitcase as claimed in claim 1, wherein the bending portion of the partition is provided with a pull member.

7. The side-opening type suitcase as claimed in claim 6, wherein when the bending portion is pulled to be bent towards the fixing portion, the partition partially covers the accommodation space.

* * * * *